US009490547B2

(12) United States Patent
Chernokalov

(10) Patent No.: US 9,490,547 B2
(45) Date of Patent: Nov. 8, 2016

(54) ELECTRICAL STEERING LENS ANTENNA

(75) Inventor: Alexander G. Chernokalov, Korolev (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 1147 days.

(21) Appl. No.: 13/552,785

(22) Filed: Jul. 19, 2012

(65) Prior Publication Data

US 2013/0021213 A1 Jan. 24, 2013

(30) Foreign Application Priority Data

Jul. 19, 2011 (RU) ..... 2011129842
May 16, 2012 (KR) ..... 10-2012-0051840

(51) Int. Cl.
*H01Q 19/06* (2006.01)

(52) U.S. Cl.
CPC ..... *H01Q 19/06* (2013.01)

(58) Field of Classification Search
CPC ..... H01Q 19/062; H01Q 3/24; H01Q 19/06; H01Q 15/08
USPC ..... 343/754, 724, 753, 876
See application file for complete search history.

(56) References Cited

U.S. PATENT DOCUMENTS 5,438,338 A * 8/1995 Thill ..... H01Q 1/1285 343/700 MS
5,448,249 A * 9/1995 Kushihi ..... H01Q 23/00 343/700 MS
5,589,842 A * 12/1996 Wang ..... H01Q 1/38 343/700 MS
6,081,239 A 6/2000 Sabet et al.

FOREIGN PATENT DOCUMENTS

| | | |
|---|---|---|
| JP | 05-014044 | 1/1993 |
| JP | 06-112728 | 4/1994 |
| JP | 10-308625 | 11/1998 |
| JP | 2002-100925 A | 4/2002 |
| JP | 3303432 B2 | 7/2002 |
| JP | 2005-354595 A | 12/2005 |

OTHER PUBLICATIONS

Korean Notice of Allowance issued on Feb. 26, 2016 in counterpart Korean Application No. 10-2012-0051840 (1 page in English, 5 pages in Korean).

* cited by examiner

*Primary Examiner* — Sue A Purvis
*Assistant Examiner* — Jae Kim
(74) *Attorney, Agent, or Firm* — NSIP Law

(57) ABSTRACT

An electrical steering lens antenna using a lens composed of a ferroelectric material is provided. The antenna includes a plate composed of a ferroelectric material. The antenna further includes a first resistive electrode disposed on a top surface of the plate. The antenna further includes a second resistive electrode disposed on a bottom surface of the plate. The antenna further includes a first conductive electrode disposed at a center of the first resistive electrode. The antenna further includes a second conductive electrode disposed along an edge of the first resistive electrode. The antenna further includes a power source connected to the first conductive electrode and the second conductive electrode.

14 Claims, 6 Drawing Sheets

ELECTRICAL STEERING LENS ANTENNA

CROSS-REFERENCE TO RELATED APPLICATION(S)

This application claims the benefit under 35 U.S.C. §119 (a) of Russian Patent Application No. 2011129842, filed on Jul. 19, 2011, in the Russian Federal Service for Intellectual Property, and Korean Patent Application No. 10-2012-0051840, filed on May 16, 2012, in the Korean Intellectual Property Office, the entire disclosures of which are incorporated herein by reference for all purposes.

BACKGROUND

1. Field

The following description relates to an apparatus configured to continuously steer a lens antenna.

2. Description of Related Art

An antenna or a portion constituting the antenna may need to adjust a radiation pattern of a radio frequency signal while the antenna and the antenna portion stay motionless, in situations. For example, the antenna and the antenna portion may need to provide switching between an omnidirectional mode and a predetermined directional mode.

There are various methods for electrical control of an operation of an antenna. In most of the methods, an antenna array may be used. A predetermined signal phase may be enhanced through the antenna array, and a lobe of a radio frequency (RF) signal radiated from the antenna array may be adjusted.

SUMMARY

In one general aspect, there is provided an electrical steering lens antenna including a plate composed of a ferroelectric material. The antenna further includes a first resistive electrode disposed on a top surface of the plate. The antenna further includes a second resistive electrode disposed on a bottom surface of the plate. The antenna further includes a first conductive electrode disposed at a center of the first resistive electrode. The antenna further includes a second conductive electrode disposed along an edge of the first resistive electrode. The antenna further includes a power source connected to the first conductive electrode and the second conductive electrode.

The plate may include a round shape.

The power source may be configured to generate and adjust a direction of an electric field along a radius of the plate to generate and adjust a distribution of a dielectric permittivity in the plate.

The second conductive electrode may include a shape of a ring.

The second resistive electrode may include a shape of a circle.

The second resistive electrode may include a resistive transparent film.

The antenna may further include a third conductive electrode disposed along an edge of the second resistive electrode, the third conductive electrode including a shape of a ring.

The first resistive electrode may include a resistive transparent film.

The first resistive electrode may include a shape of a circle.

The antenna may further include a switch configured to connect and disconnect the second resistive electrode with the first conductive electrode.

The power source may be configured to apply a zero voltage to the first conductive electrode and the second conductive electrode to generate a uniform radiation pattern.

The power source may be configured to apply a voltage to the first conductive electrode and the second conductive electrode to generate a narrow radiation pattern.

The antenna may further include a switch configured to connect and disconnect the second resistive electrode with the second conductive electrode.

The power source may be configured to apply a voltage to the first conductive electrode and the second conductive electrode to decrease a gain at a center of a radiation pattern.

The ferroelectric material may include barium strontium titanium oxide (BaxSi1-xTiO3).

The antenna may be used in a range of a millimeter wavelength.

In another general aspect, there is an electrical steering lens antenna including a lens layer including a plate composed of a ferroelectric material. The lens layer further includes a first resistive electrode disposed on a top surface of the plate. The lens layer further includes a second resistive electrode disposed on a bottom surface of the plate. The lens layer further includes a first conductive electrode disposed at a center of the first resistive electrode. The lens layer further includes a second conductive electrode disposed along an edge of the first resistive electrode. The antenna further includes a first power source connected to the first conductive electrode and the second conductive electrode. The antenna further includes a deflecting layer disposed on a top surface of the lens layer. The antenna further includes a second power source connected to the deflecting layer.

The deflecting layer may include another plate composed of the ferroelectric material, and disposed on a top surface of the first resistive electrode. The deflecting layer may further include a resistive transparent film disposed on a top surface the other plate. The deflecting layer may further include a third conductive electrode disposed at a first edge of the other plate. The deflecting layer may further include a fourth conductive electrode disposed at a second edge opposite the first edge of the other plate. The second power source may be connected to the third conductive electrode and the fourth conductive electrode.

The antenna may further include a dielectric layer disposed on a top surface of the resistive transparent film.

Other features and aspects will be apparent from the following detailed description, the drawings, and the claims.

Figure 1A:
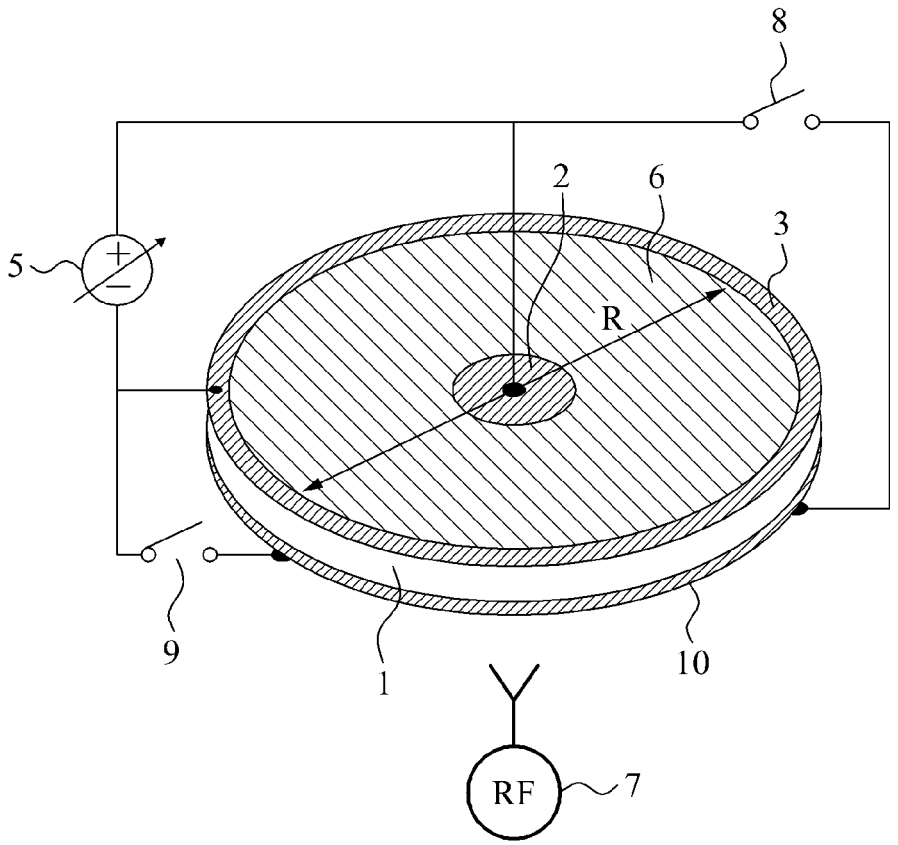
FIGS. 1A and 1B are perspective views illustrating an example of an electrical steering lens antenna.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, description of well-known functions and constructions may be omitted for increased clarity and conciseness.

Figure 1B:
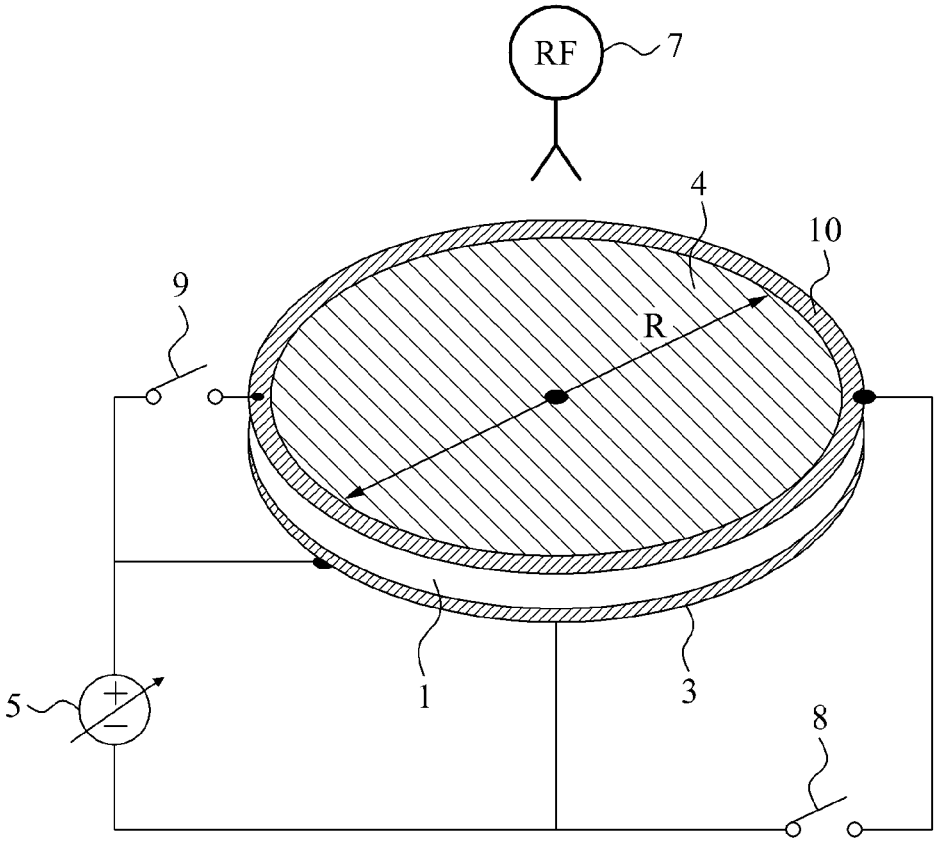

FIGS. 1A and 1B illustrate an example of an electrical steering lens antenna. To adjust a lobe of a radiation pattern of an antenna, the antenna may include a deflecting plate and/or an electro-optical lens. The deflecting plate may adjust a direction of an electromagnetic beam to be propagated through the antenna, and the electro-optical lens may adjust a width of the electromagnetic beam via power sources. The electrical steering lens antenna may generate a direction of an electric field and a distribution of a dielectric permittivity varying in a round plate composed of a ferroelectric material via a single variable power source, thereby adjusting a width of an electromagnetic beam to be propagated through the electrical steering lens antenna. The electrical steering lens antenna may be used in a range of a millimeter wavelength Referring to FIGS. 1A and 1B, the electrical steering lens antenna configured to be electrically-steered to adjust the width of the electromagnetic beam is shown. FIG. 1A is a perspective view of a top of the electrical steering lens antenna, and FIG. 1B is a perspective view of a bottom of the electrical steering lens antenna. Referring to FIGS. 1A and 1B, the electrical steering lens antenna includes a round plate 1, a first high conductivity electrode 2, a second high conductivity electrode 3, a uniform resistivity electrode 4, a variable power source 5, a high resistivity electrode 6, a switch 8, a switch 9, and a third high conductivity electrode 10. The electromagnetic beam may be provided to the electrical steering lens antenna by a radiation source 7 (e.g., a radio frequency (RF) source) disposed in a focal area.

The round plate 1 is composed of a ferroelectric material. The ferroelectric material of the round plate 1 may be determined based on properties of the ferroelectric material. For example, the ferroelectric material may include, for example, a ceramic material based on barium strontium titanium oxide ($Ba_xSr_{1-x}TiO_3$) including a strong dependence of a dielectric permittivity on an applied electric field. A thickness and a diameter of the round plate 1 may be determined based on a predetermined frequency range of the electromagnetic beam to be propagated. The first high conductivity electrode 2, the second high conductivity electrode 3, the uniform resistivity electrode 4, the high resistivity electrode 6, and the third high conductivity electrode 10 may be composed of high conductivity materials, uniform resistivity materials, and high resistivity materials, respectively, known to one of ordinary skill in the art. For example, the high conductivity materials may include conductive materials with high conductivity with respect to other conductive materials. The high resistivity materials may include insulative materials with high resistivity with respect to other insulative materials, or may include conductive materials with low conductivity with respect to other conductive materials.

The high resistivity electrode 6 is disposed on a top face of the round plate 1, and may include a round shape, i.e., a shape of a circle. The high resistivity electrode 6 may include a shape identical to a shape the round plate 1. The uniform resistivity electrode 4 is coated on a bottom face of the round plate 1, and may include a round shape.

The first high conductivity electrode 2 and the second high conductivity electrode 3 are electrically connected to the variable power source 5. The variable power source 5 may refer to a source variably adjusting a magnitude of a voltage. The first high conductivity electrode 2 and the second high conductivity electrode 3 are disposed on a surface of the high resistivity electrode 6. In more detail, the second high conductivity electrode 3 is disposed along an edge of the high resistivity electrode 6, and the first high conductivity electrode 2 is disposed at a center of the high resistivity electrode 6. The first high conductivity electrode 2 may include a shape identical to the shape of the round plate 1, and the second high conductivity electrode 3 may include a shape of a ring.

The high resistivity electrode 6 includes a transparent form for propagation of the electromagnetic beam. For example, the high resistivity electrode 6 may be composed of an electrically transparent film including a high resistivity.

Referring to FIG. 1B, the uniform resistivity electrode 4 includes a transparent form for propagation of the electromagnetic beam. For example, the uniform resistivity electrode 4 may be composed of a an electrically transparent film including a high resistivity or an uniform resistivity. The third high conductivity electrode 10 is disposed along an edge of the uniform resistivity electrode 4, and may include a shape of a ring. The uniform resistivity electrode 4 is electrically connected to the first high conductivity electrode 2 and the second high conductivity electrode 3 via a switch 8 and a switch 9, respectively.

The electrical steering lens antenna generates a distribution of a dielectric permittivity along a radius of the round plate 1 to shape the electromagnetic beam to be propagated. In more detail, the variable power source 5 applies the voltage to the round plate 1 via the first high conductivity electrode 2 and the second high conductivity electrode 3 to generate an electric field in the round plate 1. The generation of the electric field results in the generation of the distribution of the dielectric permittivity along the radius of the round plate 1. The high resistivity electrode 6 is used to achieve radial distribution of the electric field generated in the round plate 1.

Figure 2:
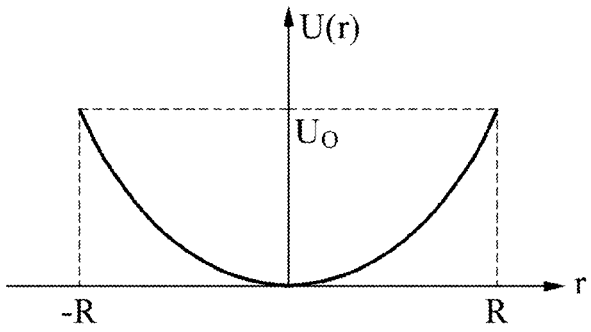
FIG. 2 is a graph illustrating an example of a distribution of an electric field generated in an electrical steering lens antenna.

FIG. 2 illustrates an example of a distribution of an electric field U(r) generated in the electrical steering lens antenna of FIGS. 1A and 1B. Referring to FIGS. 1A, 1B, and 2, r denotes a radial distance from the center of the high resistivity electrode 6 along a radius R of the high resistivity electrode 6, and $U_O$ denotes an electric field at the radius R. In a case in which the high resistivity electrode 6 includes a shape of a circle and an uniform distribution of resistance, a voltage distribution along the radius R may be shown. In this example, the uniform resistivity electrode 4 is electrically connected to the first high conductivity electrode 2 via the switch 8. By adjusting the voltage supplied to the first high conductivity electrode 2 and the second high conductivity electrode 3, the variable power source 5 adjusts the dielectric permittivity of the round plate 1, and thus, the electromagnetic beam to be propagated through the electrical steering lens antenna.

Figure 3:
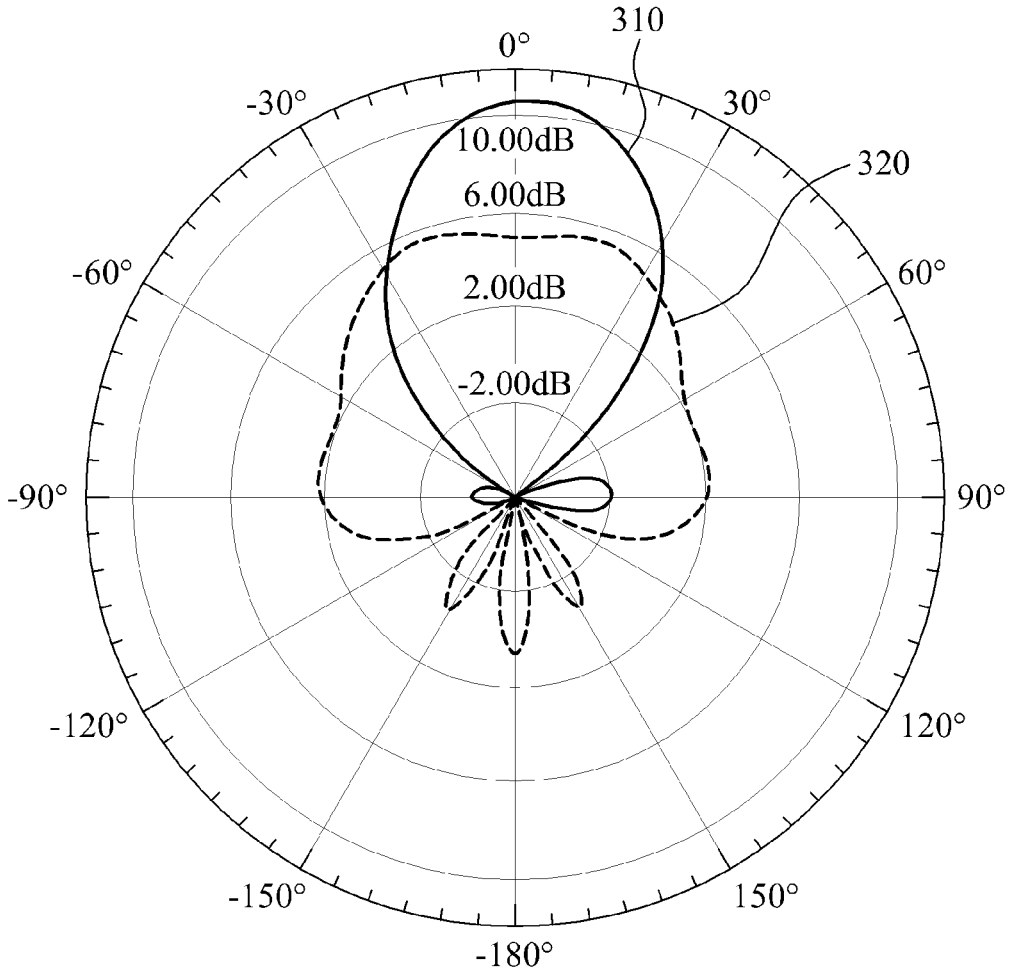
FIG. 3 is a graph illustrating an example of a radiation pattern generated in an electrical steering lens antenna.

FIG. 3 illustrates an example of a radiation pattern generated in the electrical steering lens antenna of FIGS. 1A and 1B. Referring to FIG. 3, the radiation pattern of an electromagnetic beam generated in the electrical steering lens antenna may correspond to a wide radiation pattern including an uniform distribution of a dielectric permittivity, or a narrow radiation pattern including a centered distribution of the dielectric permittivity. When the radiation source 7 of FIGS. 1A and 1B is disposed in a focal area, the narrow radiation pattern for the radiation source 7 is formed. The radiation patterns of the two cases are shown in FIG. 3.

A radiation pattern 310 is centered in a predetermined direction, and the electrical steering lens antenna is oriented in the predetermined direction. The radiation pattern 310 is generated when the variable power source 5 of FIGS. 1A and 1B applies a voltage to the round plate 1 through the first high conductivity electrode 2 and the second high conductivity electrode 3. For example, if the uniform resistivity electrode 4 is electrically connected to the first high conductivity electrode 2 via the switch 8, and the variable power source 5 applies the voltage to the round plate 1, the radiation pattern 310 is generated.

Referring again to FIG. 3, a radiation pattern 320 includes an approximately uniform distribution of a dielectric permittivity in a hemisphere ranging from −90° to 90°. In this example, a signal or beam generated by the electrical steering lens antenna may be transferred to all users in the hemisphere ranging from −90° to 90°. The radiation pattern 320 is generated when the variable power source of FIGS. 1A and 1B does not apply a voltage to the round plate 1.

Figure 4:
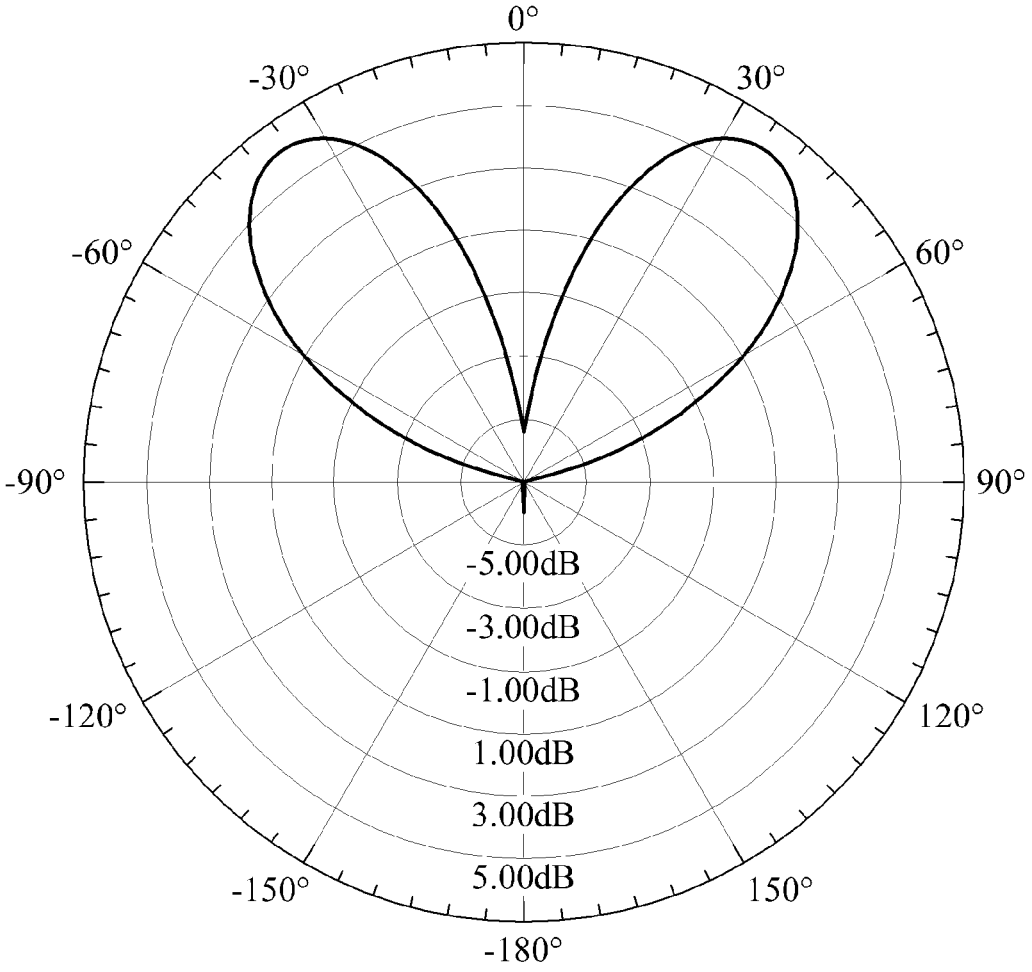
FIG. 4 is a graph illustrating another example of a radiation pattern generated in an electrical steering lens antenna.

FIG. 4 illustrates another example of a radiation pattern generated in the electrical steering lens antenna of FIGS. 1A and 1B. Referring to FIG. 4, the radiation pattern includes an inverse distribution of the radiation pattern 310 of FIG. 3. That is, the radiation pattern of FIG. 4 includes a decreased gain at a center of the radiation pattern, compared to gains at both sides of the radiation pattern. The radiation pattern of may be useful in suppressing interference from a predetermined direction. The radiation pattern is generated if the uniform resistivity electrode 4 is electrically connected to the second high conductivity electrode 3 of FIGS. 1A and 1B via the switch 9, and the variable power source 5 applies the voltage to the round plate 1.

Similar to the examples of the radiation patterns shown in FIGS. 3 and 4, shaping of a required radiation pattern may be provided based on distribution of a voltage applied to the round plate 1. The electrical steering lens antenna may be used in various antenna systems, namely, in an antenna system using a millimeter wave.

Figure 5:
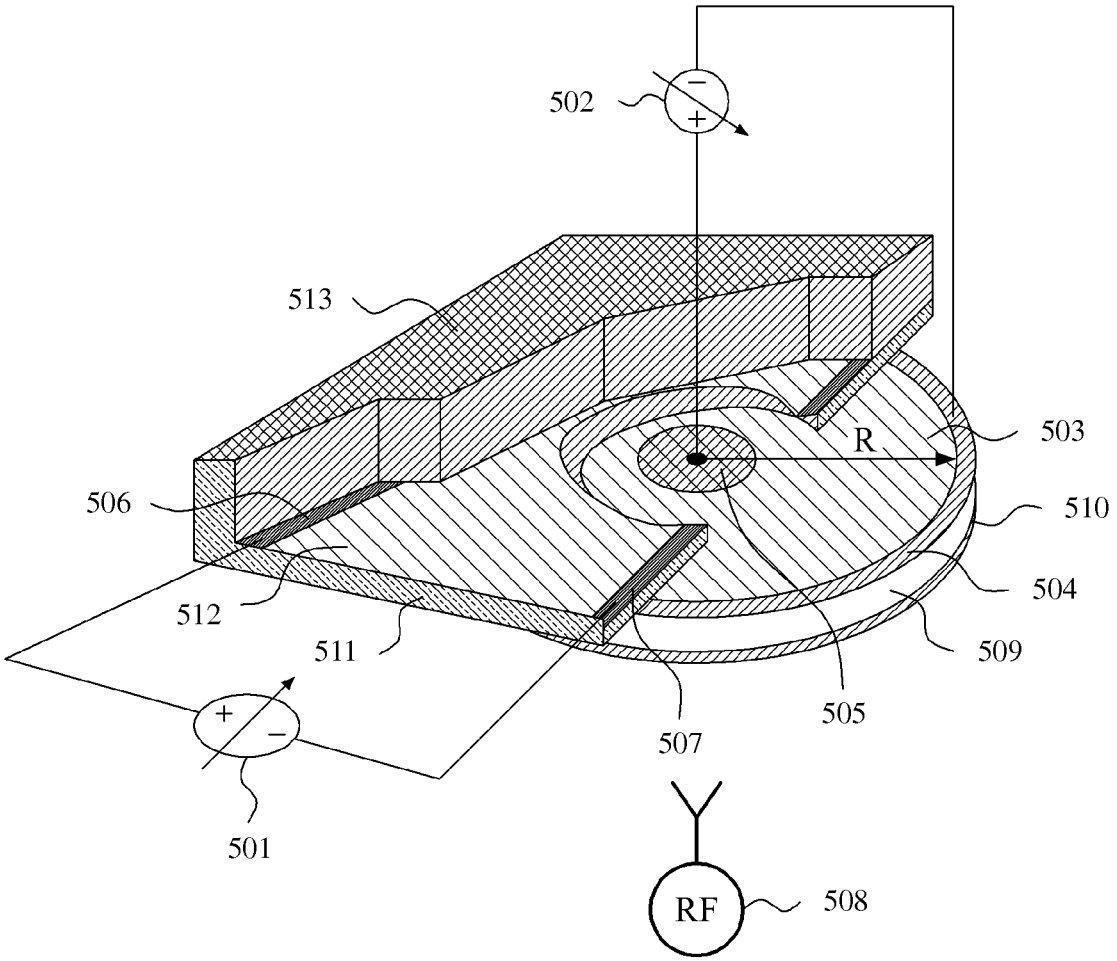
FIG. 5 is a perspective view illustrating another example of an electrical steering lens antenna.

FIG. 5 illustrates another example of an electrical steering lens antenna. Referring to FIG. 5, the electrical steering lens antenna includes a lens layer of a concentric structure and a deflecting layer. In this example, the lens layer focuses an electromagnetic beam to be propagated through the electrical steering lens antenna in a predetermined direction, and the deflecting layer converts the direction of the electromagnetic beam.

In more detail, a radiation source 508 (a RF source) generates a RF signal (e.g., the electromagnetic beam) in all directions without settings of the predetermined direction. The lens layer includes a first high resistivity electrode 503, a second high conductivity electrode 504, a first high conductivity electrode 505, a round plate 509, and a second high resistivity electrode 510. The round plate 509 is composed of a ferroelectric material, and is disposed between the first high resistivity electrode 503 and the second high resistivity electrode 510. The ferroelectric material may include, for example, a ceramic material based on $Ba_xSi_{1-x}TiO_3$. Each of the first high resistivity electrode 503 and the second high resistivity electrode 510 includes a transparent form for propagation of the electromagnetic beam. The first high conductivity electrode 505, the second high conductivity electrode 504, the first high resistivity electrode 503, and the second high resistivity electrode 510, may be composed of high conductivity materials and high resistivity materials, respectively, known to one of ordinary skill in the art. For example, the high conductivity materials may include conductive materials with high conductivity with respect to other conductive materials. The high resistivity materials may include insulative materials with high resistivity with respect to other insulative materials, or may include conductive materials with low conductivity with respect to other conductive materials.

The first high conductivity electrode 505 and the second high conductivity electrode 504 are disposed on a surface of the first high resistivity electrode 503. In more detail, the second high conductivity electrode 504 is disposed along an edge of the first high resistivity electrode 503, and the first high conductivity electrode 505 is disposed at a center of the first high resistivity electrode 503. A variable power source 502 applies and adjusts a voltage of the first high conductivity electrode 505 and the second high conductivity electrode 504 to generate and adjust a distribution of an electric field and a dielectric permittivity in the round plate 509. Accordingly, the round plate 509 operates as a lens enabling focusing of the electromagnetic beam in the predetermined direction.

The deflecting layer includes a third high conductivity electrode 506, a fourth high conductivity electrode 507, a plate 511, a high resistivity transparent film 512, and a permittivity layer 513. The plate 511 is composed of a ferroelectric material covered with the high resistivity transparent film 512 at a top surface of the ferroelectric material, and disposed on and in contact with a top surface of the first high resistivity electrode 503. The third high conductivity electrode 506, the fourth high conductivity electrode 507, the high resistivity transparent film 512, and the permittivity layer 513, may be composed of high conductivity materials and high resistivity materials, respectively, known to one of ordinary skill in the art.

The third high conductivity electrode 506 is disposed at a first edge of the plate 511, and the fourth high conductivity electrode 507 is disposed at a second edge opposite the first edge of the plate 511. A variable power source 501 applies and adjusts a voltage of the third high conductivity electrode 506 and the fourth high conductivity electrode 507 that are disposed at locations opposite to each other to generate and adjust a distribution of an electric field and a dielectric permittivity in the high resistivity transparent film 512. If the direction of the electromagnetic beam is focused in the round plate 509, the focused direction of the electromagnetic beam is deflected based on the voltage applied to the third high conductivity electrode 506 and the fourth high conductivity electrode 507, in the deflecting layer. The permittivity layer 513 is used as an anti-reflecting layer, or another deflecting layer, to deflect the direction of the electromagnetic beam in a vertical direction. The permittivity layer 513 is composed of a dielectric material, and is disposed on a top surface of the high resistivity transparent film 512.

According to the teachings above, there is provided an electrical steering lens antenna controlling a direction and a width of a main lobe with respect to an electromagnetic beam pattern radiated from the electrical steering lens antenna, without mechanically moving the electrical steering lens antenna. To control the main lobe of the electromagnetic beam pattern, a voltage to be applied to a plate of a concentric structure composed of a ferroelectric material, is adjusted. The voltage may be adjusted using a single variable power source.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An electrical steering lens antenna comprising:

a plate composed of a ferroelectric material;

a first resistive electrode disposed on a top surface of the plate;

a second resistive electrode disposed on a bottom surface of the plate;

a first conductive electrode disposed at a center of the first resistive electrode;

a second conductive electrode disposed along an edge of the first resistive electrode;

a power source connected to the first conductive electrode and the second conductive electrode;

a third conductive electrode disposed along an edge of the second resistive electrode, the third conductive electrode comprising a shape of a ring; and a switch configured to connect the second resistive electrode with the first conductive electrode.

2. The antenna of claim 1, wherein the plate comprises a round shape.

3. The antenna of claim 1, wherein the power source is configured to:

generate and adjust a direction of an electric field along a radius of the plate to generate and adjust a distribution of a dielectric permittivity in the plate.

4. The antenna of claim 1, wherein the second conductive electrode comprises a shape of a ring.

5. The antenna of claim 1, wherein the second resistive electrode comprises a shape of a circle.

6. The antenna of claim 1, wherein the second resistive electrode comprises a resistive transparent film.

7. The antenna of claim 1, wherein the first resistive electrode comprises a resistive transparent film.

8. The antenna of claim 1, wherein the first resistive electrode comprises a shape of a circle.

9. The antenna of claim 1, wherein the power source is configured to:

apply a zero voltage to the first conductive electrode and the second conductive electrode to generate a uniform radiation pattern.

10. The antenna of claim 1, wherein the power source is configured to:

apply a voltage to the first conductive electrode and the second conductive electrode to generate a narrow radiation pattern.

11. An electrical steering lens antenna comprising:

a plate composed of a ferroelectric material;

a first resistive electrode disposed on a top surface of the plate;

a second resistive electrode disposed on a bottom surface of the plate;

a first conductive electrode disposed at a center of the first resistive electrode;

a second conductive electrode disposed along an edge of the first resistive electrode;

a power source connected to the first conductive electrode and the second conductive electrode;

a third conductive electrode disposed along an edge of the second resistive electrode, the third conductive electrode comprising a shape of a ring; and a switch configured to connect and disconnect the second resistive electrode with the second conductive electrode.

12. The antenna of claim 1, wherein the power source is configured to:

apply a voltage to the first conductive electrode and the second conductive electrode to decrease a gain at a center of a radiation pattern.

13. The antenna of claim 1, wherein the ferroelectric material comprises barium strontium titanium oxide ($Ba_xSi_{1-x}TiO_3$).

14. The antenna of claim 1, wherein the antenna is used in a range of a millimeter wavelength.

* * * * *